US011585623B2

(12) United States Patent
Borunsky

(10) Patent No.: US 11,585,623 B2
(45) Date of Patent: Feb. 21, 2023

(54) FIREARM SUPPRESSOR BAFFLES AND RELATED MULTI-BAFFLE CONFIGURATIONS FOR INCREASED SOUND AND FLASH SUPPRESSION

(71) Applicant: Michael Borunsky, Pueblo, CO (US)

(72) Inventor: Michael Borunsky, Pueblo, CO (US)

( * ) Notice: Subject to any disclaimer, the term of this patent is extended or adjusted under 35 U.S.C. 154(b) by 0 days.

(21) Appl. No.: 17/374,995

(22) Filed: Jul. 14, 2021

(65) Prior Publication Data

US 2022/0018623 A1 Jan. 20, 2022

Related U.S. Application Data

(60) Provisional application No. 63/166,947, filed on Mar. 26, 2021, provisional application No. 63/052,744, filed on Jul. 16, 2020.

(51) Int. Cl.
*F41A 21/30* (2006.01)

(52) U.S. Cl.
CPC ..... *F41A 21/30* (2013.01)

(58) Field of Classification Search
CPC ..... F41A 21/30
USPC ..... 89/14.4; 181/223
See application file for complete search history.

(56) References Cited

U.S. PATENT DOCUMENTS

| | | | |
|---|---|---|---|
| 2,375,617 | A | 5/1945 | Bourne |
| 2,442,773 | A | 6/1948 | Mason |
| 2,448,382 | A | 8/1948 | Mason |
| 2,448,593 | A | 9/1948 | Heising |
| 2,780,962 | A | 2/1957 | Ressler et al. |
| 2,868,078 | A | 1/1959 | Jarrett |
| 2,872,848 | A | 2/1959 | Schuessler |
| 3,385,164 | A | 5/1968 | Walther et al. |
| 3,478,841 | A | 11/1969 | Hubner |
| 3,500,955 | A | 3/1970 | WerBell |
| 3,667,570 | A | 6/1972 | WerBell, III |
| 3,677,132 | A | 7/1972 | Plenge |
| 3,713,362 | A | 1/1973 | Charron |
| 3,748,956 | A | 7/1973 | Hubner |
| 3,952,629 | A | 4/1976 | Boccarossa et al. |
| 4,291,610 | A | 9/1981 | Waiser |
| 4,384,507 | A | 5/1983 | Finn |

(Continued)

FOREIGN PATENT DOCUMENTS

| | | |
|---|---|---|
| FR | 007874490-0001 | 5/2020 |
| FR | 007874490-0002 | 5/2020 |
| WO | 202081268 | 4/2020 |

*Primary Examiner* — Bret Hayes
(74) *Attorney, Agent, or Firm* — Withers + Keys, LLC

(57) ABSTRACT

Suppressors and baffles therein provide for sound and/or flash suppression of a firearm. The baffles include a first cone portion, a second cone portion, and a neck connecting the first cone portion and the second cone portion. The first cone portion and second cone portion define a passageway through which hot gases and a bullet may be expelled through and out of the suppressor. The first cone portion directs at least some expelled gases around the outer edge of the first cone portion and to the neck and second cone portion. The second cone portion together with a suppressor body block movement of the expelled gases. A port in the neck allows the expelled gases blocked by the second cone portion to escape toward the passageway to disrupt the flow of the expelled gases and thereby further suppress the sound and/or flash.

20 Claims, 17 Drawing Sheets

(56) References Cited

U.S. PATENT DOCUMENTS

| | | | | |
|---|---|---|---|---|
| 4,392,412 | A | 7/1983 | Schmidt et al. | |
| 4,501,189 | A | 2/1985 | Brandl et al. | |
| 4,530,417 | A | 7/1985 | Daniel | |
| 4,576,083 | A | 3/1986 | Seberger, Jr. | |
| 4,576,084 | A | 3/1986 | Brandl et al. | |
| 4,584,924 | A | 4/1986 | Taguchi | |
| 4,588,043 | A | 5/1986 | Finn | |
| 4,907,488 | A | 3/1990 | Seberger | |
| 4,920,854 | A | 5/1990 | Scanlon | |
| 4,928,573 | A | 5/1990 | Fansler et al. | |
| 4,974,489 | A | 12/1990 | Fishbaugh | |
| 5,029,512 | A | 7/1991 | Latka | |
| 5,136,923 | A | 8/1992 | Walsh, Jr. | |
| 5,164,535 | A | 11/1992 | Leasure | |
| 5,679,916 | A | 10/1997 | Werchert | |
| 6,079,311 | A | 6/2000 | O'Quinn et al. | |
| 6,302,009 | B1 | 10/2001 | O'Quinn et al. | |
| 6,374,718 | B1 | 4/2002 | Rescigno et al. | |
| 6,575,074 | B1 | 6/2003 | Gaddini | |
| 6,575,266 | B1 | 6/2003 | Gehse et al. | |
| 7,308,967 | B1 | 12/2007 | Hoel | |
| 7,987,944 | B1 | 8/2011 | Brittingham et al. | |
| 8,100,224 | B1 | 1/2012 | Olson | |
| 8,807,272 | B2 | 8/2014 | Bladen | |
| 8,844,422 | B1 * | 9/2014 | Klett | F41A 21/34 89/14.4 |
| 8,991,550 | B2 | 3/2015 | Coley | |
| 9,366,495 | B1 * | 6/2016 | Coppinger | F41A 21/30 |
| 9,593,899 | B2 | 3/2017 | Coppinger et al. | |
| 10,119,779 | B1 | 11/2018 | Miele et al. | |
| 10,267,586 | B1 * | 4/2019 | Marfione | F41A 21/30 |
| 10,563,944 | B2 | 2/2020 | Campbell et al. | |
| 2012/0272818 | A1 | 11/2012 | Dueck et al. | |
| 2016/0018179 | A1 * | 1/2016 | Morris | F41A 21/30 181/223 |
| 2018/0172383 | A1 * | 6/2018 | James | F41A 21/30 |
| 2018/0202744 | A1 | 7/2018 | DeSousa | |
| 2019/0145727 | A1 * | 5/2019 | Campbell | F41A 21/30 89/14.4 |
| 2020/0025494 | A1 | 1/2020 | Parker | |
| 2020/0224989 | A1 * | 7/2020 | Bundy | F41A 21/325 |
| 2021/0341246 | A1 * | 11/2021 | Kunsky | F41A 21/30 |
| 2021/0381791 | A1 * | 12/2021 | Magee | F41A 21/30 |

* cited by examiner

FIREARM SUPPRESSOR BAFFLES AND RELATED MULTI-BAFFLE CONFIGURATIONS FOR INCREASED SOUND AND FLASH SUPPRESSION

TECHNICAL FIELD

Embodiments relate to suppressors and baffles for firearms.

BACKGROUND

Firearms propel a bullet through a barrel of the firearm by an explosion occurring within a chamber. The explosion produces a high velocity expulsion of gases that propel the bullet through the barrel. However, the high velocity expulsion of hot gases escaping from the barrel produce a substantial amount of sound and a visible flash. It is often desirable to reduce the amount of sound and/or flash escaping from the barrel. Firearm suppressors are mounted on the end of the barrel to reduce the sound and/or flash. However, even with existing firearm suppressors, it is desirable to further reduce the amount of sound and/or flash that exits the suppressor.

SUMMARY

Embodiments address issues such as these and others by providing firearm suppressors with baffles that include features that further reduce the amount of sound and/or flash that exits the suppressor.

Embodiments provide a suppressor for a firearm that comprises a suppressor body and at least one baffle having a fixed position within the suppressor. The at least one baffle comprises a first cone portion having an outer radius, the first cone portion defining a passageway that passes through the first cone portion. The at least one baffle comprises a second cone portion having an outer diameter, the second cone portion further defining the passageway that passes through the second cone portion, the second cone portion adjoining the suppressor body at the outer diameter of the second cone portion. The at least one baffle further comprises a neck connecting the first cone portion to the second cone portion, the neck having a reduced radius relative to the outer radius of the first cone portion, the neck comprising a port that passes through the neck to provide an exit into the passageway.

Embodiments provide a baffle for a suppressor of a firearm that comprises a first cone portion having an outer radius, the first cone portion defining a passageway that passes through the first cone portion. The baffle comprises a second cone portion further defining the passageway that passes through the second cone portion. The baffle further comprises a neck connecting the first cone portion to the second cone portion, the neck having a reduced radius relative to the outer radius of the first cone portion, the neck comprising a port that passes through the neck to provide an exit into the passageway.

Embodiments provide a firearm that comprises a barrel and a suppressor mounted on an end of the barrel. The suppressor comprises a suppressor body and at least one baffle having a fixed position within the suppressor. The at least one baffle comprises a first cone portion having an outer radius, the first cone portion defining a passageway that passes through the first cone portion. The baffle comprises a second cone portion having an outer diameter, the second cone portion further defining the passageway that passes through the second cone portion, the second cone portion adjoining the suppressor body at the outer diameter of the second cone portion. The baffle further comprises a neck connecting the first cone portion to the second cone portion, the neck having a reduced radius relative to the outer radius of the first cone portion, the neck comprising a port that passes through the neck to provide an exit into the passageway.

DESCRIPTION OF THE DRAWINGS

FIG. 13AA shows a second cross-sectional view of the stack of baffles from the second firearm suppressor example to demonstrate the effects of the baffle design on the flow of gases through the firearm suppressor example.

FIG. 13BB shows a second cross-sectional view of the stack of baffles from the second firearm suppressor example to demonstrate the effects of the baffle design on the flow of gases through the firearm suppressor example.

DETAILED DESCRIPTION

Embodiments of firearm suppression baffles and baffle configurations are shown and described below. These baffles and multi-baffle configurations affect the gas flowing through the firearm suppressor to reduce sound and/or flash escaping from the firearm suppressor.

Figure 1:
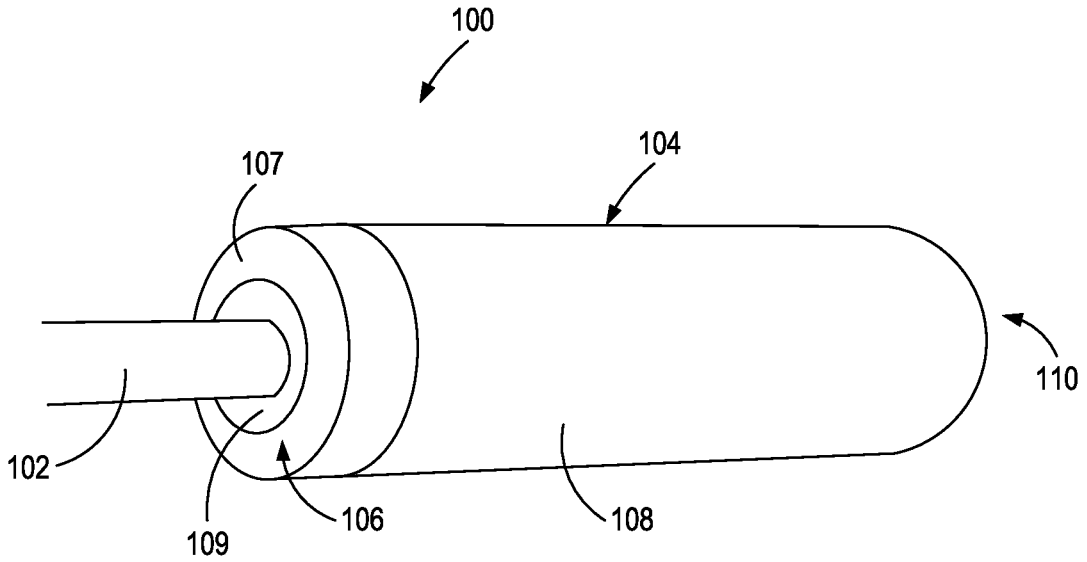
FIG. 1 shows the barrel of a firearm with a first example of a firearm suppressor mounted to the end of the barrel.
Figure 2A:
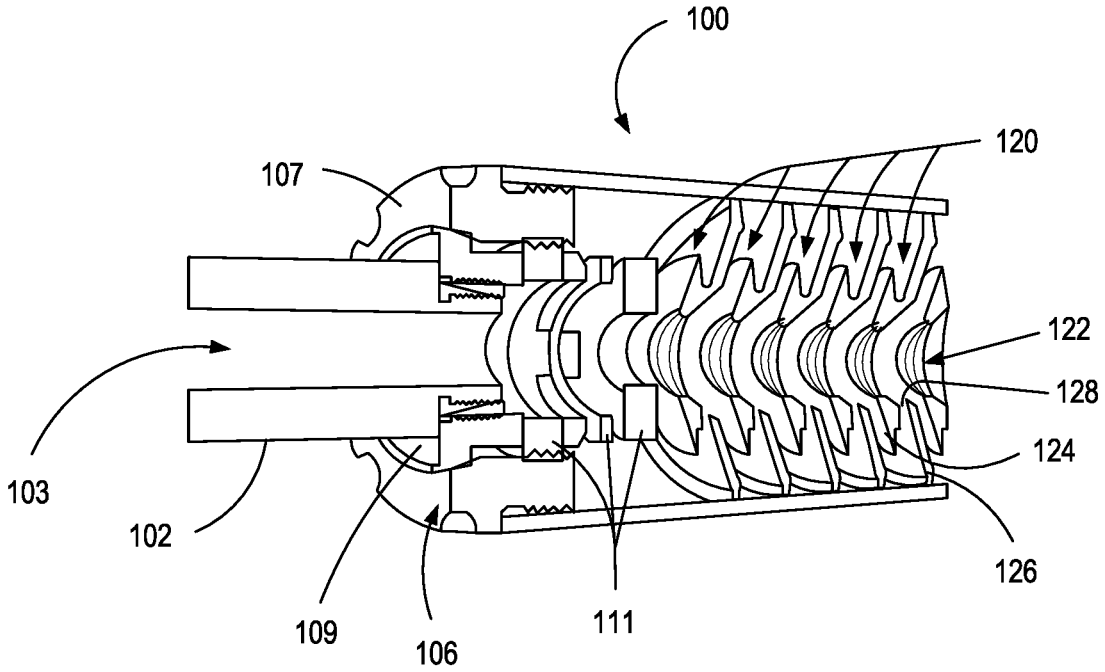
FIG. 2A shows a cross-sectional view taken though the center of the barrel and firearm suppressor example where internal baffles can be seen within the firearm suppressor.

FIGS. 1 and 2A show a firearm apparatus 100 that includes a gun having a barrel 102 defining a bore 103 that allows a bullet and hot gases to escape in a chosen direction. The remainder of the gun is not shown but it will be understood that many varieties of guns will have a barrel 102 that allows for attachment of a firearm suppressor 104. The firearm suppressor 104 may utilize a conventional suppressor coupling 106 to attach the firearm suppressor 104 to the barrel in a conventional manner. The coupling 106 may include an outer coupling member 107, an inner coupling member 109, and internal coupling members 111 that work in the conventional manner to create the attachment to the barrel 102.

The firearm suppressor 104 also includes a suppressor body 108 that provides a housing for the internal baffles 120 as well as the internal couplings 111. The baffles 120 provide an improvement over suppressors with conventional baffles by affecting the gas flow through the suppressor 104 in an advantageous manner discussed in more detail below with reference to FIG. 2B.

Figure 2B:
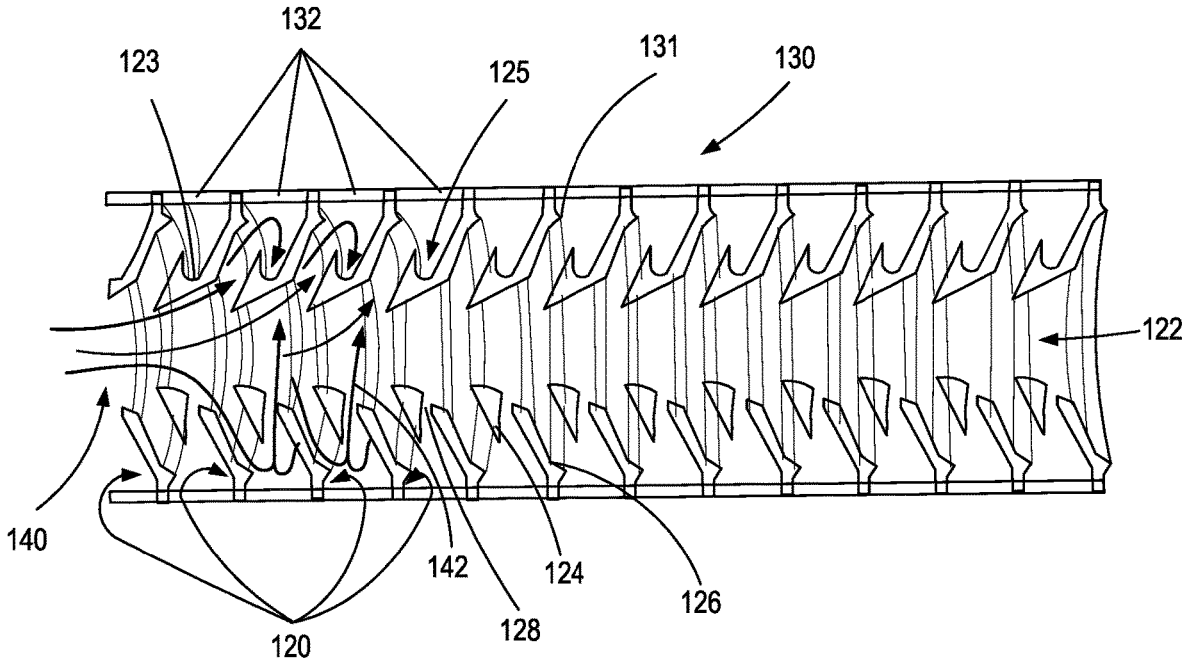
FIG. 2B shows a cross-sectional view of the stack of baffles from the firearm suppressor example to demonstrate the effects of the baffle design on the flow of gases through the firearm suppressor example.

FIG. 2A shows that the baffles 120 include a first cone portion 124 and a second cone portion 126 that define a passageway 122 through the baffles 120 to allow the bullet to escape while providing the advantageous effects upon the escaping gases. The baffles 120 also include at least one port 128 that resides in a reduced radius region that connects the cone portion 124 and cone portion 126. This reduced radius region is referred to as a reduced radius neck 123 as shown in FIGS. 2B, 3B, and others herein. The placement of the port 128 in the neck 123 allows the exit of the port to be in closer proximity to the flow of gases through the passageway 122.

In FIG. 2B it can be seen that the hot gases have a direction of flow 140 passing into the passageway 122 of the stack 130 of baffles that resides within the suppressor body 108 (not shown in FIG. 2B). The hot gas flow 140 encounters the baffles 120 and some of the flow through the passageway 122 is diverted by the first cone portion 124 of each baffle. As the first cone portion 124 of this example has a diameter for at least some amount of the cone portion or circumference, or the entire cone portion circumference in some examples, that is smaller than spacers 132 that are present to separate each of the baffles 120 at a desired distance, the gases flow beyond the outer edge of the first cone portion 124 so as to encircle the reduced radius neck 123 within a region 125 created by the underside of the first cone portion 124, the neck 123, and the top side of the second cone portion 126. In this example, the outer diameter of the second cone portion 126 and flange 127 is large enough for at least some amount of the cone portion circumference, or the entire cone portion circumference in some examples, to prevent the gas flow from escaping around those outer edges of the second cone portion 126 so that gas flow is instead directed through the at least one port 128 in the neck 123. Additionally, the underside of the second portion 126 may include a ridge 131 that also helps to direct the gas flow around the first cone portion 124 of the next baffle 120.

Figure 7:
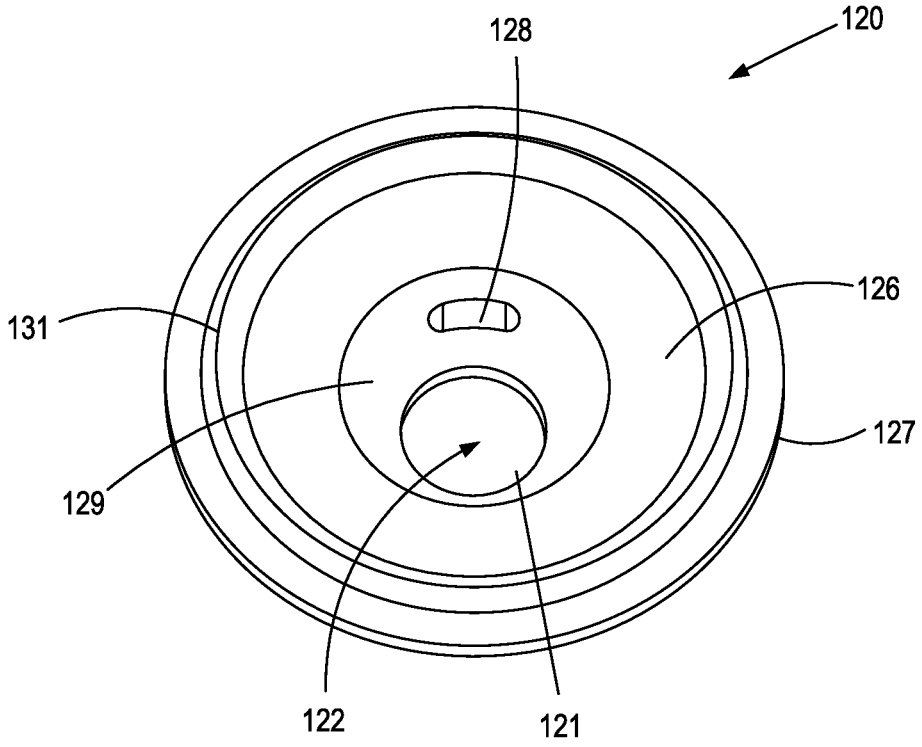
FIG. 7 shows a bottom perspective view of the first baffle example.

The pressure of the gases within the region 125 cause the gas flow to travel through the port 128 in the neck 123 where the gas flow 142 escaping the port 128 is initially at an angle that is perpendicular to the flow of gas through the passageway 122 as viewed down the longitudinal axis of the passageway 122. Because the port 128 is present in the neck 123, the exit of the port 128 is in closer proximity to the gas flow through the passageway 122, as illustrated in FIGS. 2A, 2B, and 7, which is believed to further increase the disruption of the gas flow through the passageway 122. The flow of gases out of the port 128 and across the flow of gases through the passageway 122 disrupts the flow of gases through the passageway 122 and further diverts flow around the first cone portion 124 of the next baffle 120 in the configuration. This gas flow disruption occurs for each baffle the gas flow encounters when traveling through the suppressor 104. It is this disruption of the flow of gases through the passageway 122 by way of the gas flow escaping through the port 128 that results in the reduction of sound and/or flash that ultimately exits out the end of the suppressor body 108. While a single port 128 of a given shape is shown in the figures, it will be appreciated that additional ports 128 may also be present and may have a different shape than that shown while still being capable of channeling gas flow across the flow of gas through the passageway 122 so as to disrupt the gas flow.

The length of the suppressor 104, the number of baffles to include, and the spacing of the baffles can be chosen to balance interests of cost, weight, and suppression level. However, as shown in FIG. 2B, it is also effective to include the first cone portion 124 within the interior space defined by the second cone portion 126 of the preceding baffle 120 in some examples. The materials chosen for the suppressor body 108, spacers, and baffles can also vary depending upon cost, durability, and weight. Materials that can be used for these components of the suppressor 104 include rigid materials such as metals and other rigid materials. Examples of metals include but are not limited to aluminum, stainless steel, titanium alloys, and the like.

Figure 3A:
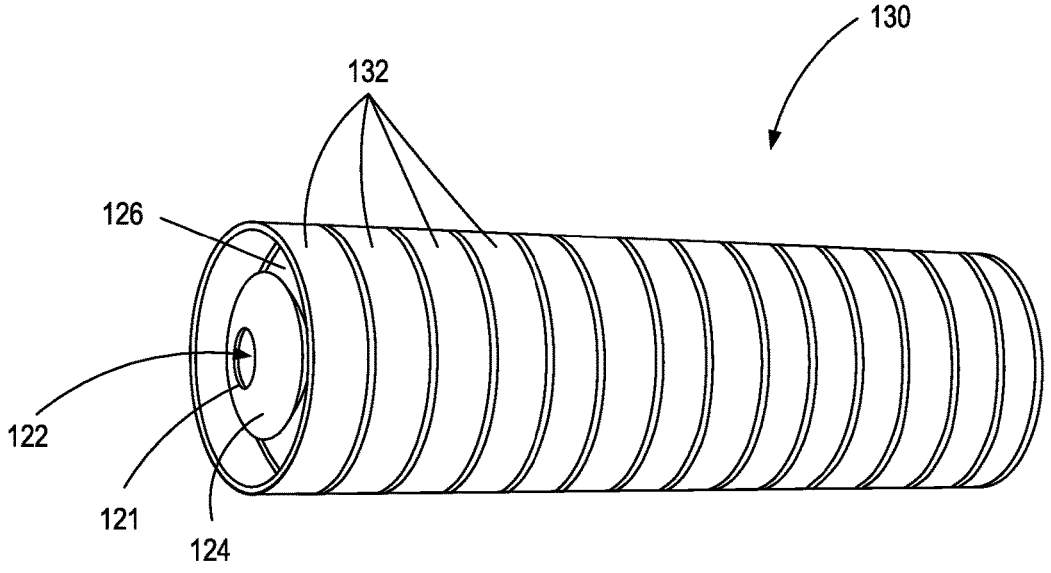
FIG. 3A shows an example of the configuration of the stack of baffles.
Figure 3B:
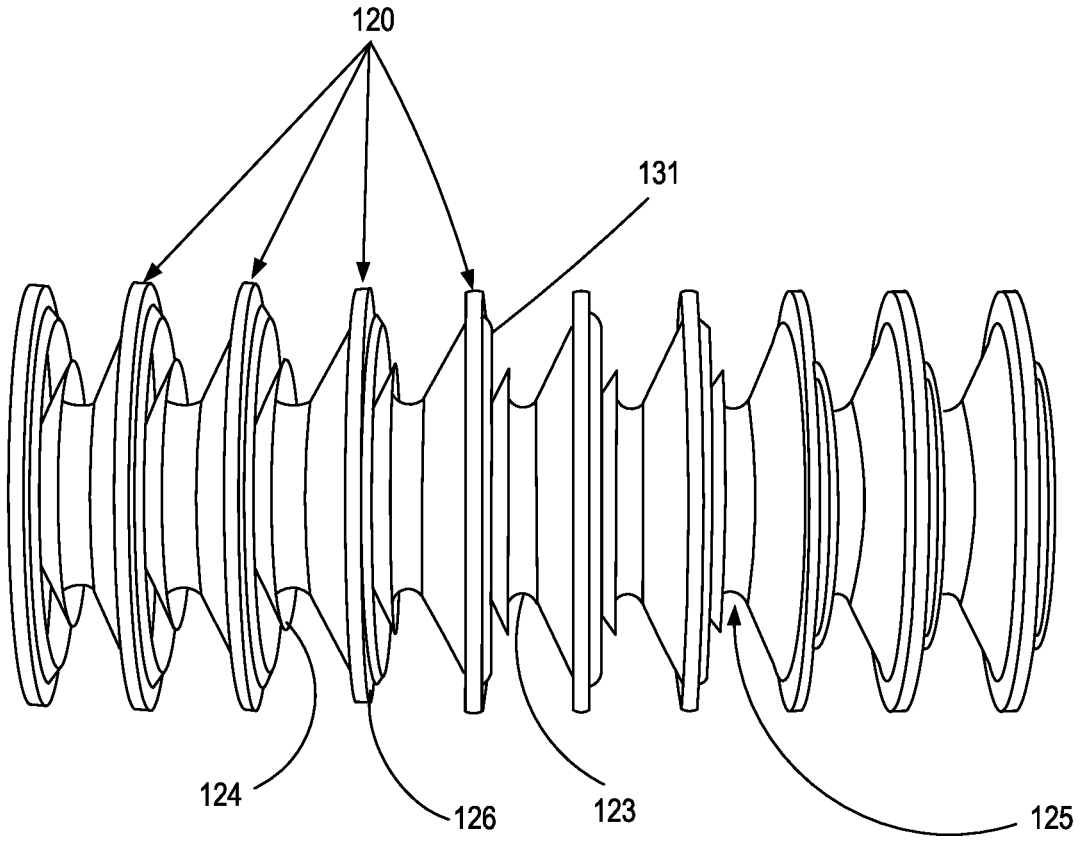
FIG. 3B shows an example of the configuration of the stack of baffles with spacers removed to reveal the relationship of the adjacent baffles.
Figure 4:
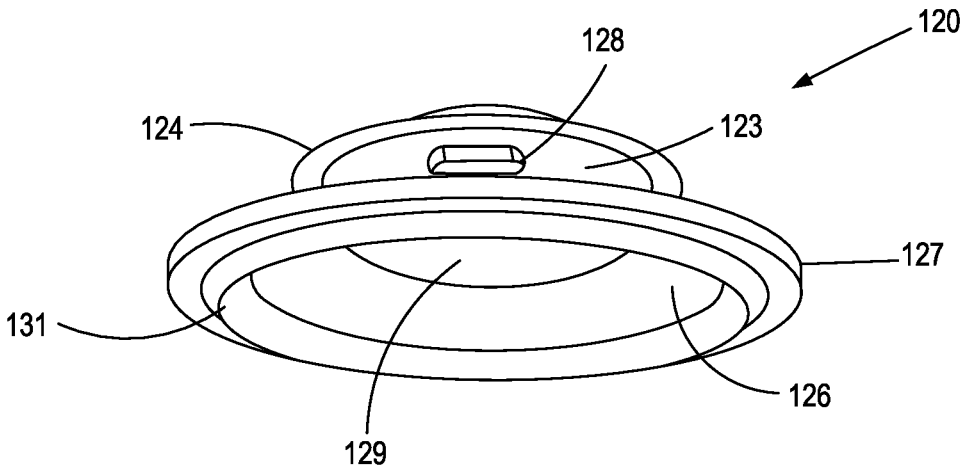
FIG. 4 shows a bottom side perspective view of a first example of a baffle.

FIG. 3A shows the outer appearance of the stack 130 of baffles with the spacers 132 in position. FIG. 3B shows the outer appearance of the stack without the spacers 132 in place to further demonstrate one example of the relationship of the first cone portion 124 of one baffle 120 to the second cone portion 126 of the preceding baffle 120.

Figure 5:
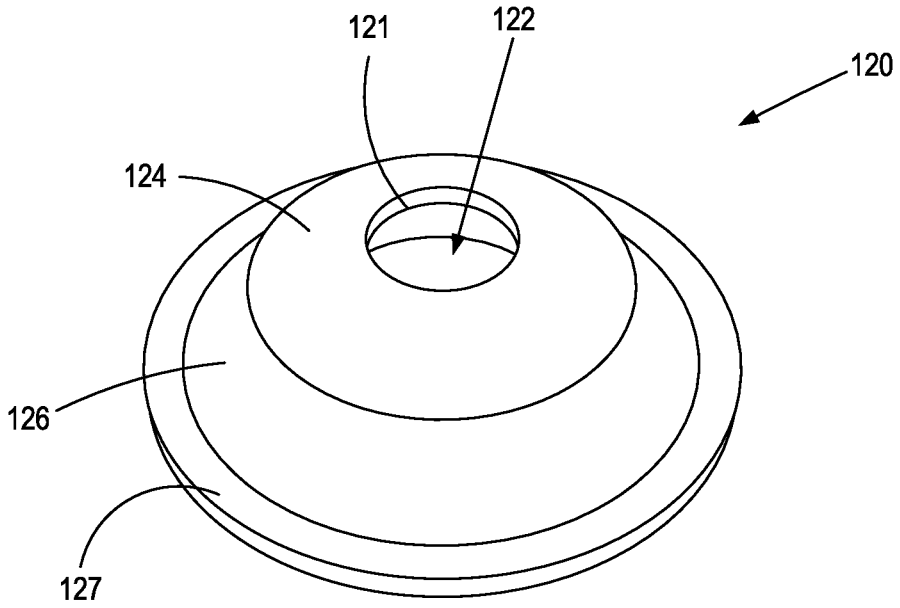
FIG. 5 shows a top side perspective view of the first baffle example.
Figure 6:
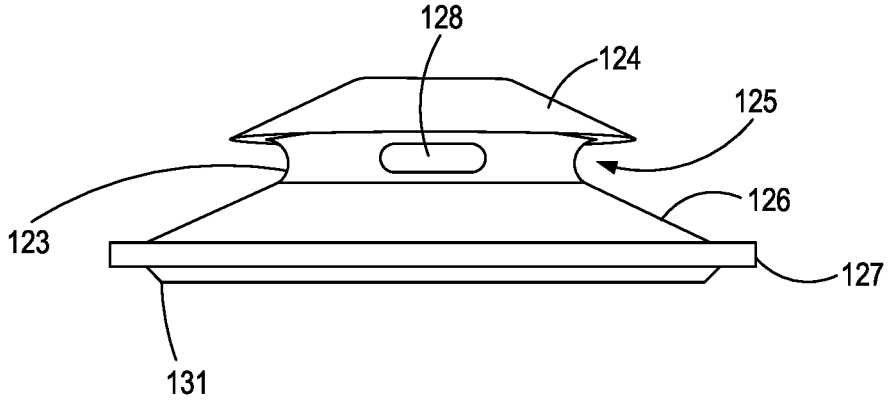
FIG. 6 shows a front view of the first baffle example.
Figure 8:
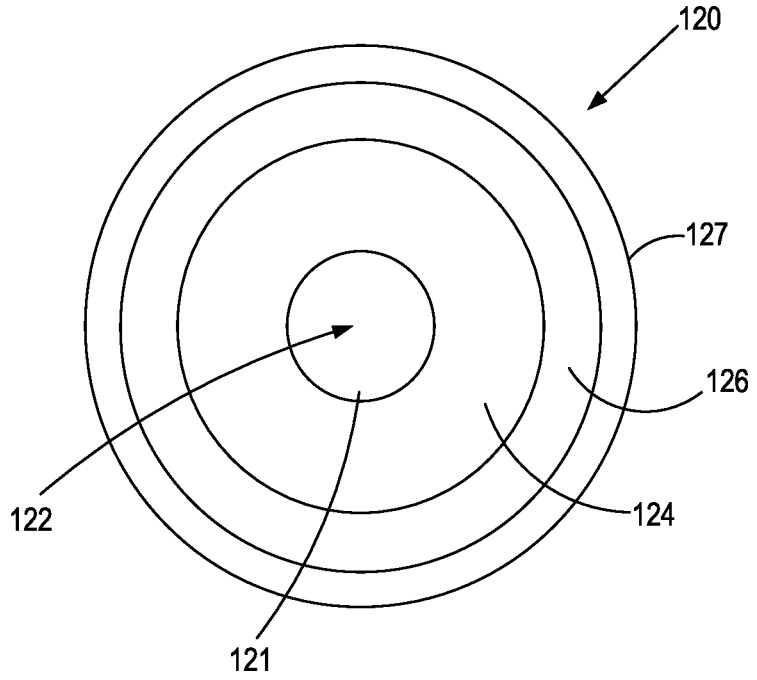
FIG. 8 shows a top view of the first baffle example.

FIGS. 4-8 show various views of an individual baffle 120. Within these views, it can be seen that this example includes features such as a flange 127 around the second cone portion 126 where the flange 127 engages that inner surface of the suppressor body 108 and also engages spacers 132 on each side of the flange 127. It can be seen that in this example, the second cone portion 126 includes a conical inner surface that provides room for the first cone portion 124 of the next baffle 120 in the stack 130 of FIG. 3A and which in conjunction with the ridge 131 also helps direct gas flow around the first cone portion 124 of that next baffle in the stack 130. Figures including FIG. 5 and FIG. 8 show that the first cone portion 124 includes a defined hole 121 that creates the passageway 122 for the bullet. FIGS. 6 and 7 illustrate the port 128 and its presence in the neck 123 having the reduced radius relative to the outer radius of the first cone portion 124. FIG. 7 also shows the exit of the port in a neck inner surface 129 which may also be conical to aid in the diversion of gases around the first cone portion 124 of the next baffle 120 in the stack 130.

Figure 9:
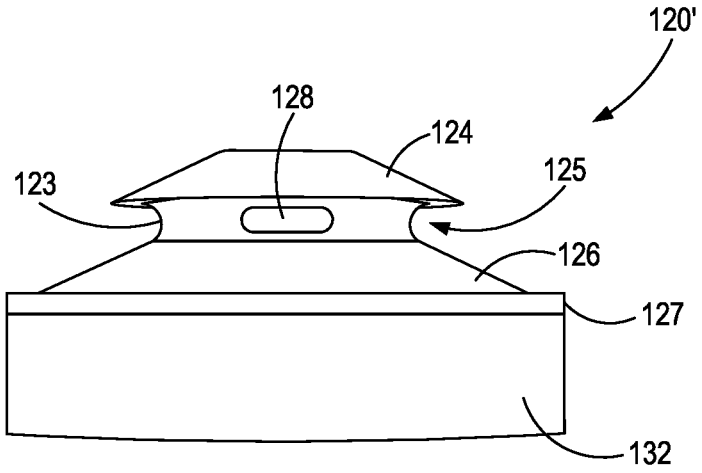
FIG. 9 shows a front view of a first baffle example that includes a spacer.
Figure 10:
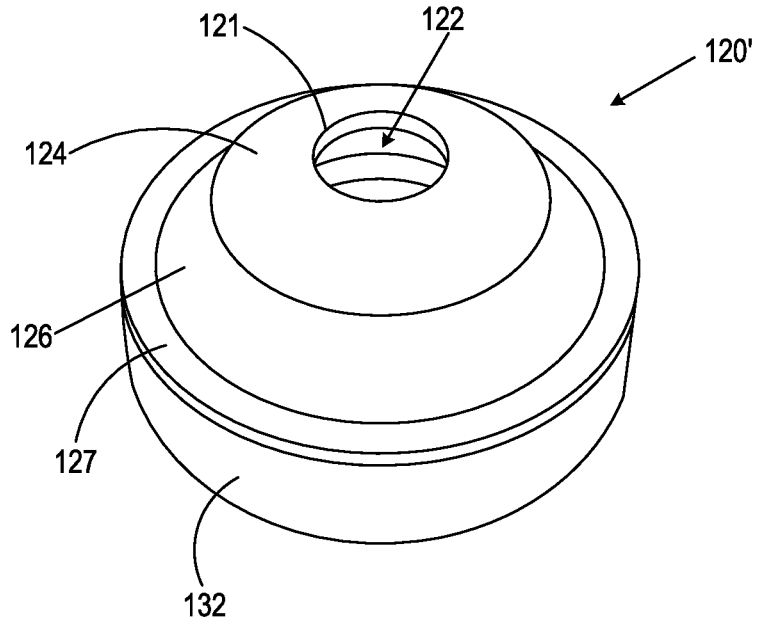
FIG. 10 shows a top side perspective view of the first baffle example that includes the spacer.
Figure 11:
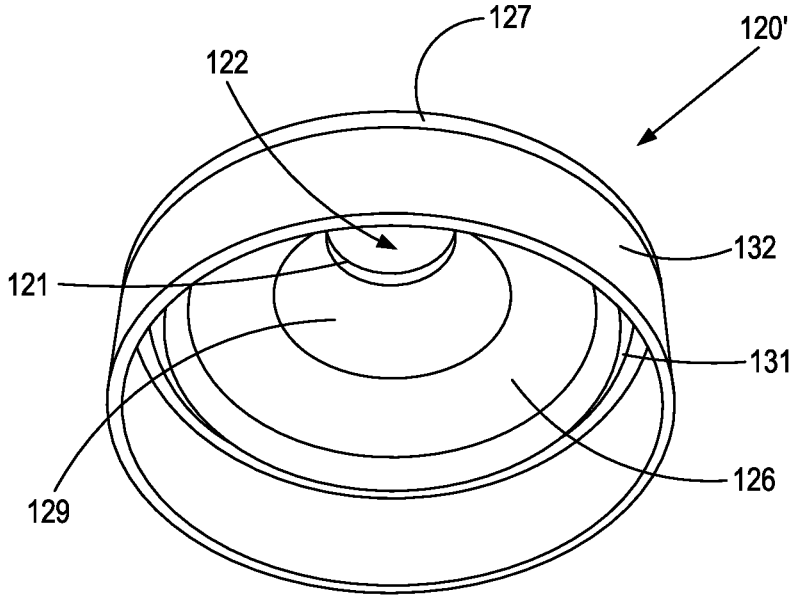
FIG. 11 shows a bottom side perspective view of the first baffle example that includes the spacer.

FIGS. 9-11 show various views of an individual baffle 120' that is the same as the baffle above but also includes the spacer 132. The spacer 132 may be an integral component of the baffle 120' that is either machined from the same block of material, additively manufactured as one piece of material, or created from two separate components that are joined together by a weld or other manner. Alternatively, the spacer 132 may exist as a separate component where the flange 127 merely sits upon the edge of the spacer 132. Note that in FIG. 11, the surface 129 is shown from an angle that does not reveal the at least one port 128. However, the at least one port 128 is present in baffle 120' such that the gas flow is directed the same for this example regardless of whether the spacer 132 is integral to the baffle 120' or a separate component. The size of the spacer 132 can vary, and the size dictates the proximity of the baffles 120 to each other and also dictates the number of baffles that can fit within a given suppressor body 108. Thus, the spacer 132 can be sized so that a given suppressor body 108 can accommodate the desired number of baffles 120 and/or the desired spacing of the baffles 120.

Figure 12A:
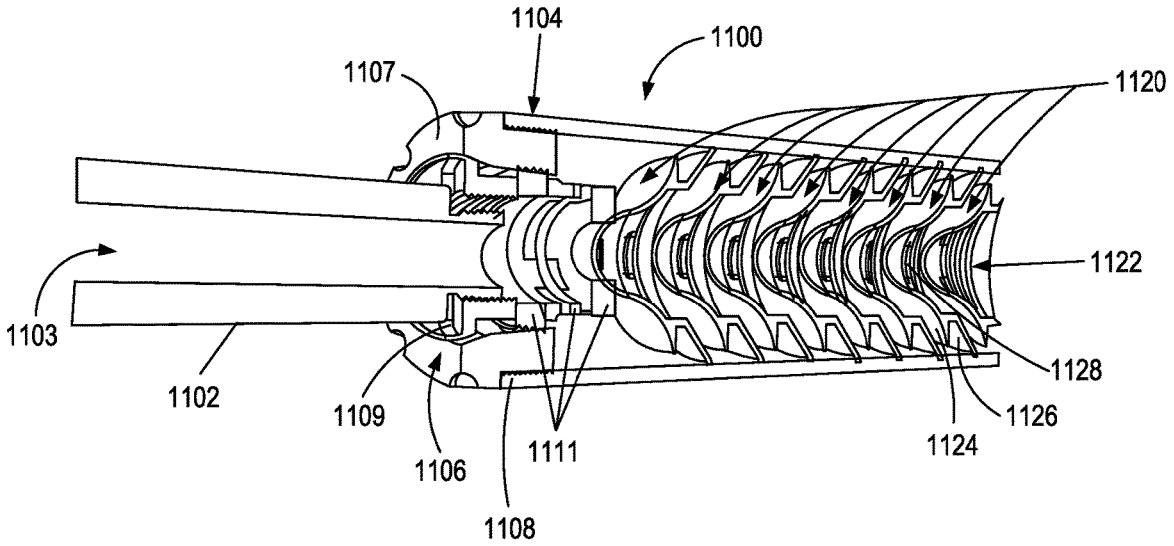
FIG. 12A shows a cross-sectional view taken though the center of the barrel and a second firearm suppressor example where internal baffles can be seen within the firearm suppressor.

FIGS. 12A-19B are directed to second and third examples that have shown to be effective particularly for supersonic gas velocities. The second and third examples of suppressors and baffles shown in FIGS. 12A-19B may be configured like the first suppressor example 104 and gun barrel 102 as shown in FIG. 1. FIG. 12A shows a firearm apparatus 1100 that includes a gun having a barrel 1102 defining a bore 1103 that allows a bullet and hot gases to escape in a chosen direction. The remainder of the gun is not shown but it will be understood that many varieties of guns will have a barrel 1102 that allows for attachment of a second firearm suppressor example 1104. The firearm suppressor 1104 may utilize a conventional suppressor coupling 1106 to attach the firearm suppressor 1104 to the barrel in a conventional manner. The coupling 1106 may include an outer coupling member 1107, an inner coupling member 1109, and internal coupling members 1111 that work in the conventional manner to create the attachment to the barrel 1102.

The firearm suppressor 1104 also includes a suppressor body 1108 that provides a housing for the internal baffles 1120 as well as the internal couplings 1111. The baffles 1120 provide an improvement over suppressors with conventional baffles by affecting the gas flow through the suppressor 1104 in an advantageous manner discussed in more detail below with reference to FIGS. 13A and 13AA.

Figure 13A:
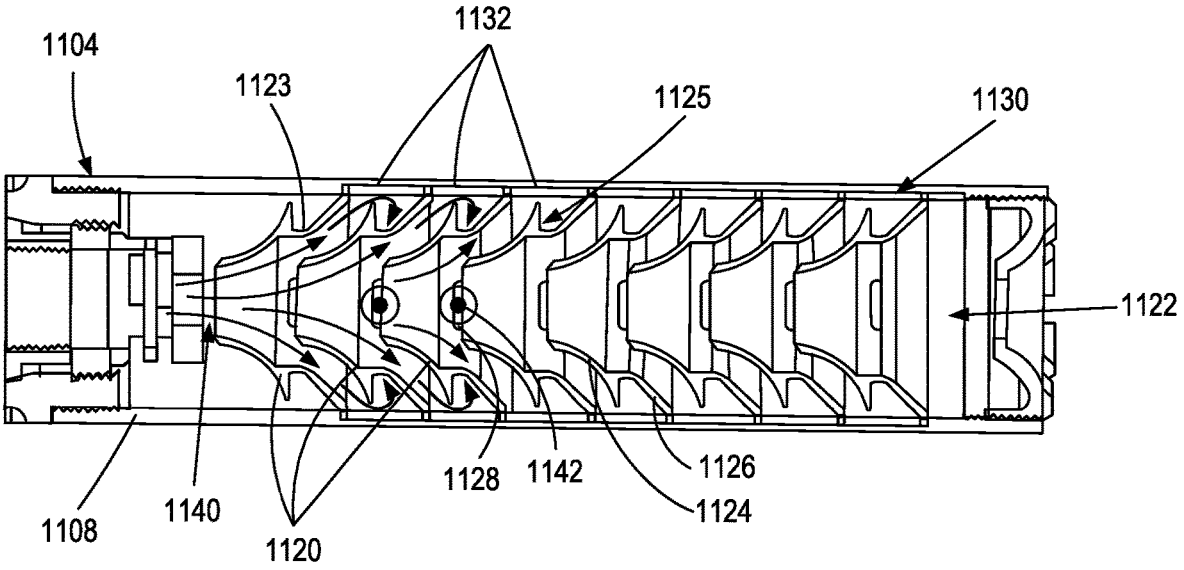
FIG. 13A shows a first cross-sectional view of the stack of baffles from the second firearm suppressor example to demonstrate the effects of the baffle design on the flow of gases through the firearm suppressor example.
Figure 13A:
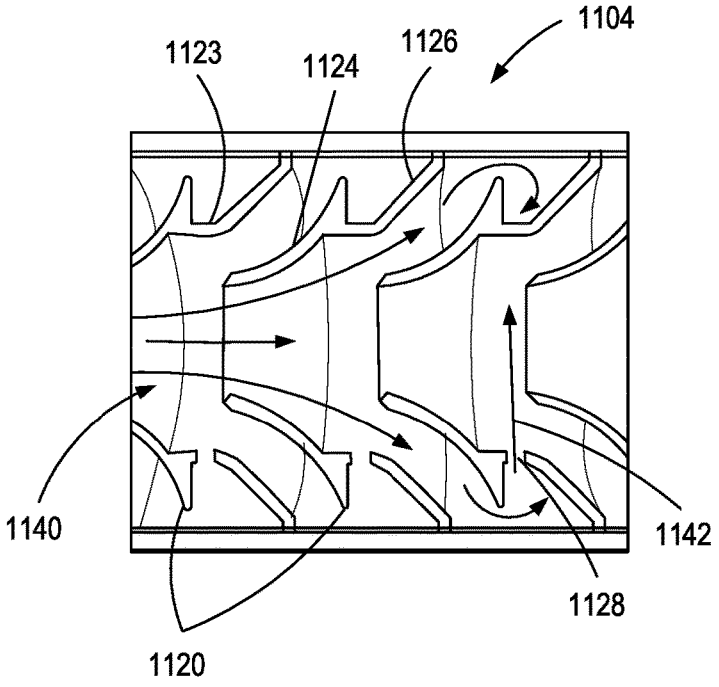

FIGS. 13A and 13AA show that the baffles 1120 include a first cone portion 1124 and a second cone portion 1126 that define a passageway 122 through the baffles 1120 to allow the bullet to escape while providing the advantageous effects upon the escaping gases. The baffles 1120 also include at least one port 1128 that resides in a reduced radius region that connects the cone portion 1124 and cone portion 1126. This reduced radius region is referred to as a reduced radius neck 1123 as shown in FIGS. 13A, 13AA, 14A and others herein. The placement of the port 1128 in the neck 1123 allows the exit of the port to be in closer proximity to the flow of gases through the passageway 1122.

It should be noted that the first cone portion 1124 has multiple differences relative to the first cone portion 124 of the first example discussed above in relation to FIGS. 1-11. As one example of a difference, this first cone portion 1124 defines a curvature extending from the top of the cone at the smaller radius and diameter to the bottom of the cone at the larger radius and diameter on both the inner and outer surfaces. Another example of a difference is that this first cone portion 124 is elongated in the axial dimension of the suppressor 1100. Yet another difference is that this first cone portion 1124 has a larger outer radius and diameter. Another difference pertains to the spacing between baffles 1120, but the first cone portion 1124 allows a spacing where the small radius and diameter portion of the first cone portion 1124 is present in close proximity to the port 1128 of the adjacent baffle 1120. It will be appreciated that one or all of these differences may be applied to a baffle that otherwise is designed like the first baffle example 120.

In FIGS. 13A and 13AA it can be seen that the hot gases have a direction of flow 1140 passing into the passageway 1122 of the stack 1130 of baffles that resides within the suppressor body 1108. The hot gas flow 1140 encounters the baffles 1120 and some of the flow through the passageway 1122 is diverted by the first cone portion 1124 of each baffle. As the first cone portion 1124 of this example has a diameter for at least some amount of the cone portion or circumference, or the entire cone portion circumference in some examples, that is smaller than spacers 1132 that are present to separate each of the baffles 1120 at a desired distance, the gases flow beyond the outer edge of the first cone portion 1124 so as to encircle the reduced radius neck 1123 within a region 1125 created by the underside of the first cone portion 1124, the neck 1123, and the top side of the second cone portion 1126. In this example, the outer diameter of the second cone portion 1126 and flange 1127 is large enough for at least some amount of the cone portion circumference, or the entire cone portion circumference in some examples, to prevent the gas flow from escaping around those outer edges of the second cone portion 1126 so that gas flow is instead directed through the at least one port 1128 in the neck 1123. While not shown for the second baffle example 1120, the underside of the second portion 1126 may include a ridge like the ridge 131 of the first baffle example 120 that also helps to direct the gas flow around the first cone portion 1124 of the next baffle 1120.

The pressure of the gases within the region 1125 cause the gas flow to travel through the port 1128 in the neck 1123 where the gas flow 1142 escaping the port 1128 is initially at an angle that is perpendicular to the flow of gas through the passageway 1122 as viewed down the longitudinal axis of the passageway 1122. It will be appreciated that in the view of FIG. 13A, the direction of gas flow 1142 is out of the page, and the arrow of gas flow direction 1142 uses the convention of a circle with a center dot to represent that that arrow of gas flow direction 1142 is pointing out of the page. Because the port 1128 is present in the neck 1123, the exit of the port 1128 is in closer proximity to the gas flow through the passageway 1122, which is believed to further increase the disruption of the gas flow through the passageway 1122. It will also be noted that in this particular example, the portion 1128 is immediate adjacent the top of the next baffle 1120 in the series so that the gas flow 1142 is immediately adjacent the entry to this next baffle 1120 in the series.

The flow of gases out of the port 1128 and across the flow of gases through the passageway 1122 disrupts the flow of gases through the passageway 1122 and further diverts flow around the first cone portion 1124 of the next baffle 1120 in the configuration. This gas flow disruption occurs for each baffle the gas flow encounters when traveling through the suppressor 1104. It is this disruption of the flow of gases through the passageway 1122 by way of the gas flow escaping through the port 1128 that results in the reduction of sound and/or flash that ultimately exits out the end of the suppressor body 1108. While a single port 1128 of a given shape is shown in the figures, it will be appreciated that additional ports 1128 may also be present and may have a different shape than that shown while still being capable of channeling gas flow across the flow of gas through the passageway 1122 so as to disrupt the gas flow.

The length of the suppressor 1104, the number of baffles to include, and the spacing of the baffles can be chosen to balance interests of cost, weight, and suppression level. However, as shown in FIGS. 13A and 13AA, it is also effective to include the first cone portion 1124 within the interior space defined by the second cone portion 1126 of the preceding baffle 1120 in some examples. The materials chosen for the suppressor body 1108, spacers, and baffles can also vary depending upon cost, durability, and weight. Materials that can be used for these components of the suppressor 1104 include rigid materials such as metals and other rigid materials. Examples of metals include but are not limited to aluminum, stainless steel, titanium alloys, and the like.

It will be appreciated that the outer appearance of the stack 1130 of baffles with the spacers 1132 in position looks essentially like that of FIGS. 3A and 3B except for the differences noted in the features of the individual baffles present therein.

Figure 15A:
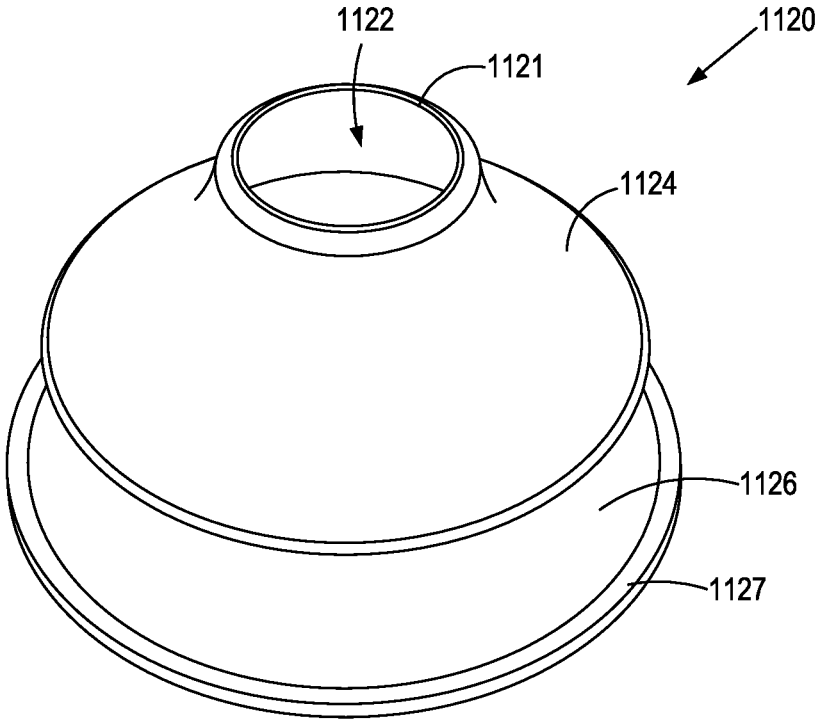
FIG. 15A shows a top side perspective view of the second baffle example.
Figure 16A:
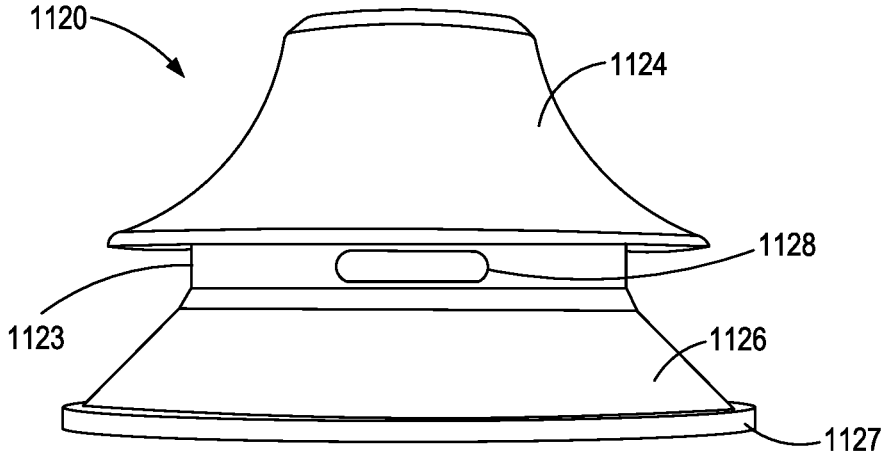
FIG. 16A shows a front view of the second baffle example.
Figure 17:
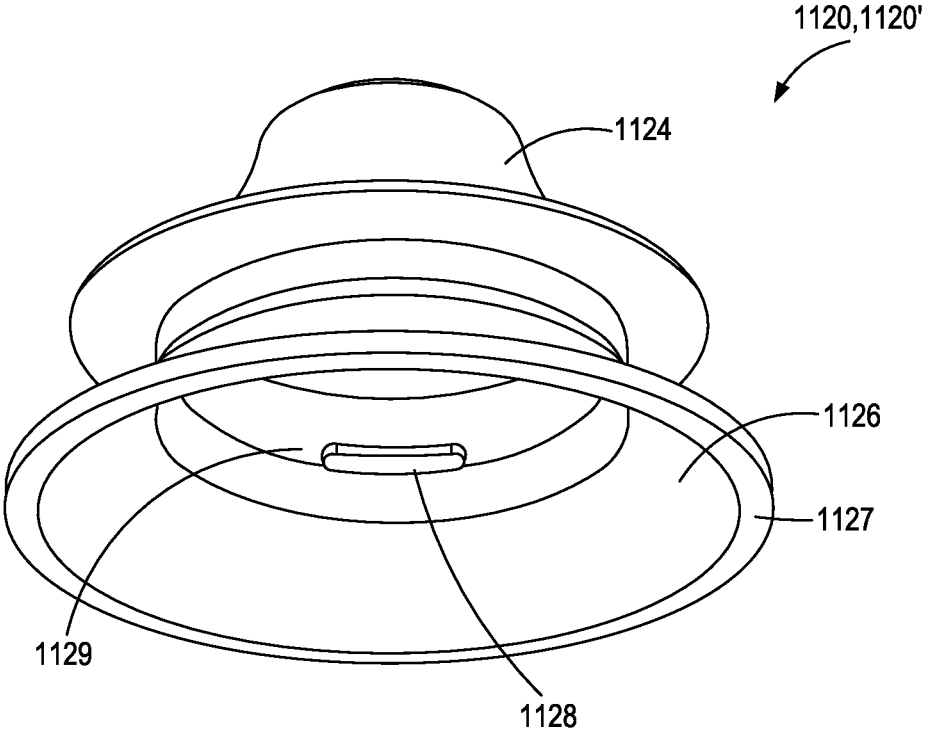
FIG. 17 shows a bottom perspective view of the second and third baffle examples.
Figure 17A:
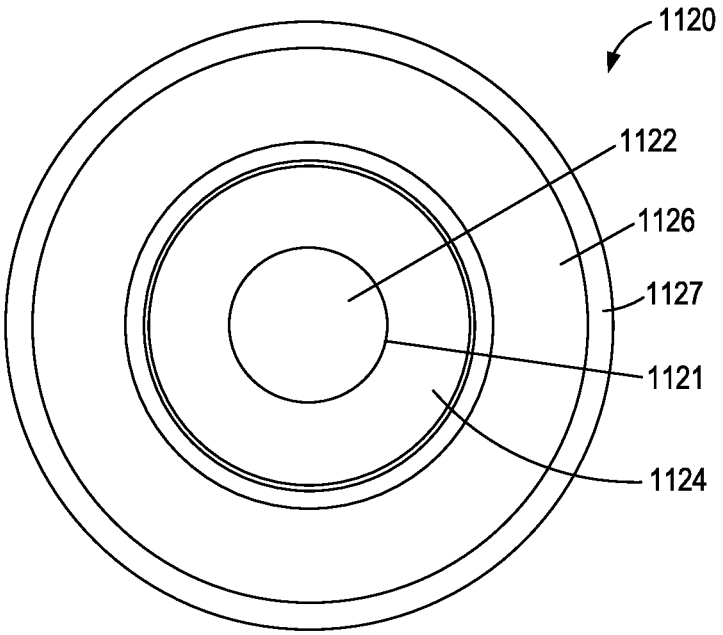
FIG. 17A shows a bottom view of the second baffle example.
Figure 17B:
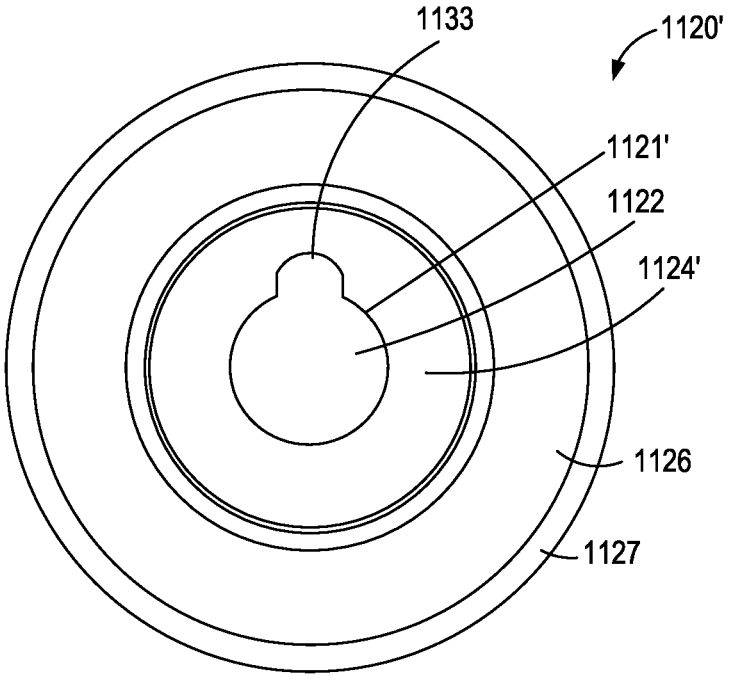
FIG. 17B shows a bottom view of the third baffle example.
Figure 18A:
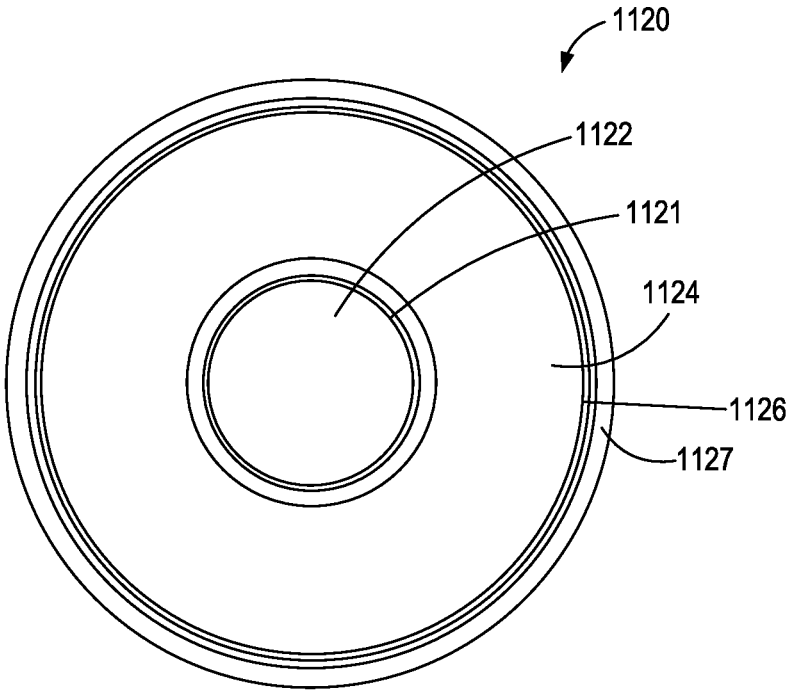
FIG. 18A shows a top view of the second baffle example.

FIGS. 14A, 15A, 16A, 17, 17A, and 18A show various views of an individual baffle 1120. Within these views, it can be seen that this example includes features such as a flange 1127 around the second cone portion 1126 where the flange 1127 engages that inner surface of the suppressor body 1108 and also engages spacers 1132 on each side of the flange 1127. It can be seen that in this example, the second cone portion 1126 includes a conical inner surface that provides room for the first cone portion 1124 of the next baffle 1120 in the stack 1130. Figures including FIG. 15A and FIG. 18A show that the first cone portion 1124 includes a defined hole 1121 that creates the passageway 1122 for the bullet. FIGS. 16A and 17 illustrate the port 1128 and its presence in the neck 1123 having the reduced radius relative to the outer radius of the first cone portion 1124.

Figure 19A:
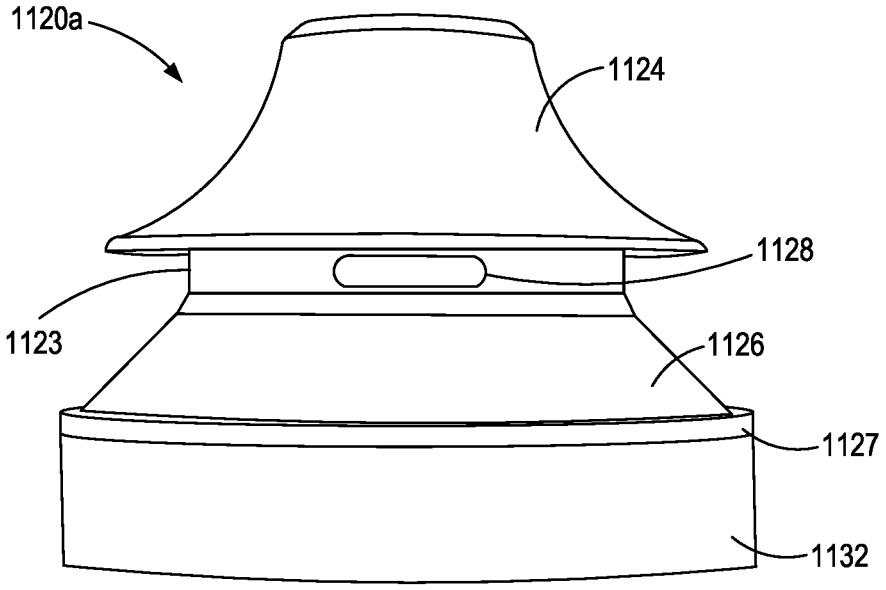
FIG. 19A shows a front view of the second baffle example that includes a spacer.

FIG. 19A shows an individual baffle 1120*a* that is the same as the baffle 1120 above but also includes the spacer 1132. The spacer 1132 may be an integral component of the baffle 1120*a* that is either machined from the same block of material, additively manufactured as one piece of material, or created from two separate components that are joined together by a weld or other manner. Alternatively, the spacer 1132 may exist as a separate component where the flange 1127 merely sits upon the edge of the spacer 1132. At least one port 1128 is present in baffle 1120*a* such that the gas flow is directed the same for this example regardless of whether the spacer 1132 is integral to the baffle 1120*a* or a separate component. The size of the spacer 1132 can vary, and the size dictates the proximity of the baffles 1120 to each other and also dictates the number of baffles that can fit within a given suppressor body 1108. Thus, the spacer 1132 can be sized so that a given suppressor body 1108 can accommodate the desired number of baffles 1120 and/or the desired spacing of the baffles 1120.

Figure 12B:
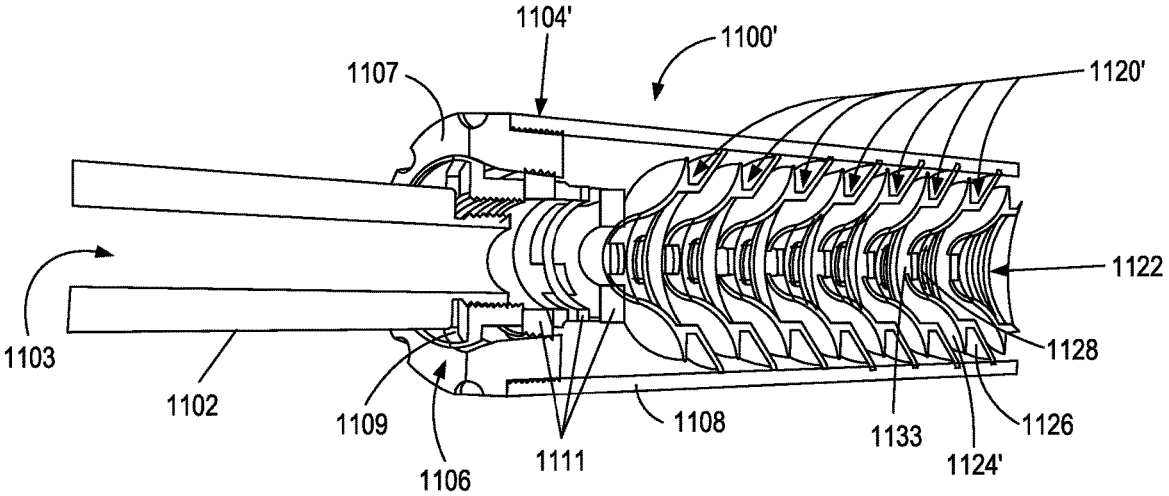
FIG. 12B shows a cross-sectional view taken though the center of the barrel and a third firearm suppressor example where internal baffles can be seen within the firearm suppressor.

As for the third example of a suppressor and baffles, FIG. 12B shows a firearm apparatus 1100' that includes a gun having a barrel 1102 defining a bore 1103 that allows a bullet and hot gases to escape in a chosen direction. The remainder of the gun is not shown but it will be understood that many varieties of guns will have a barrel 1102 that allows for attachment of a second firearm suppressor example 1104'. The firearm suppressor 1104' may utilize a conventional suppressor coupling 1106 to attach the firearm suppressor 1104' to the barrel in a conventional manner. The coupling 1106 may include an outer coupling member 1107, an inner coupling member 1109, and internal coupling members 1111 that work in the conventional manner to create the attachment to the barrel 1102.

The firearm suppressor 1104' also includes a suppressor body 1108 that provides a housing for the internal baffles 1120' as well as the internal couplings 1111. The baffles 1120' provide an improvement over suppressors with conventional baffles by affecting the gas flow through the suppressor 1104' in an advantageous manner discussed in more detail below with reference to FIGS. 13B and 13BB.

Figure 13B:
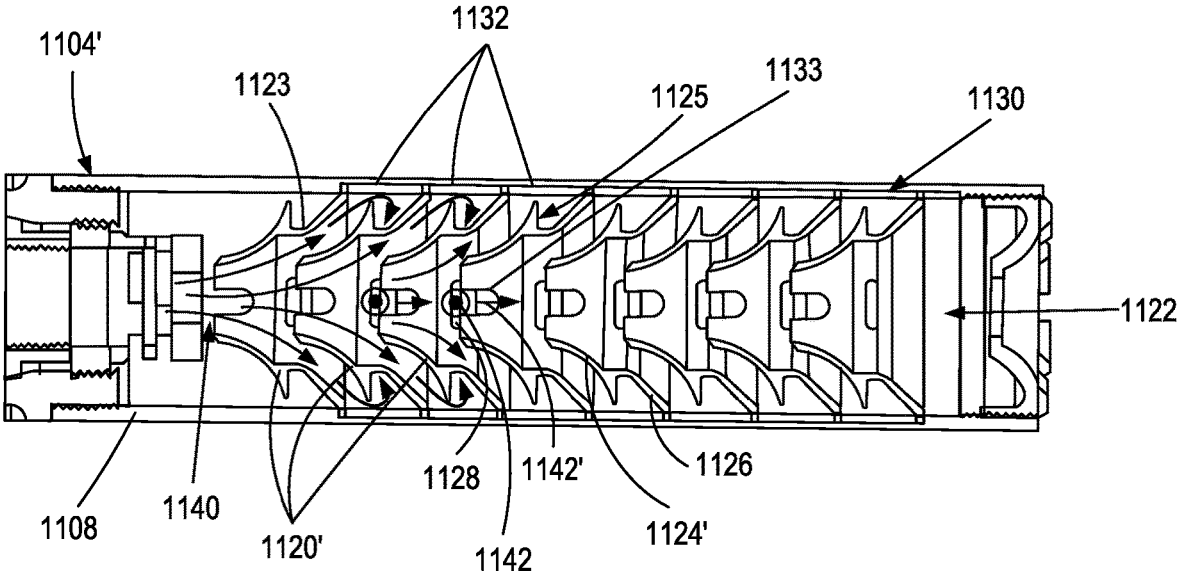
FIG. 13B shows a first cross-sectional view of the stack of baffles from the second firearm suppressor example to demonstrate the effects of the baffle design on the flow of gases through the firearm suppressor example.
Figure 13B:
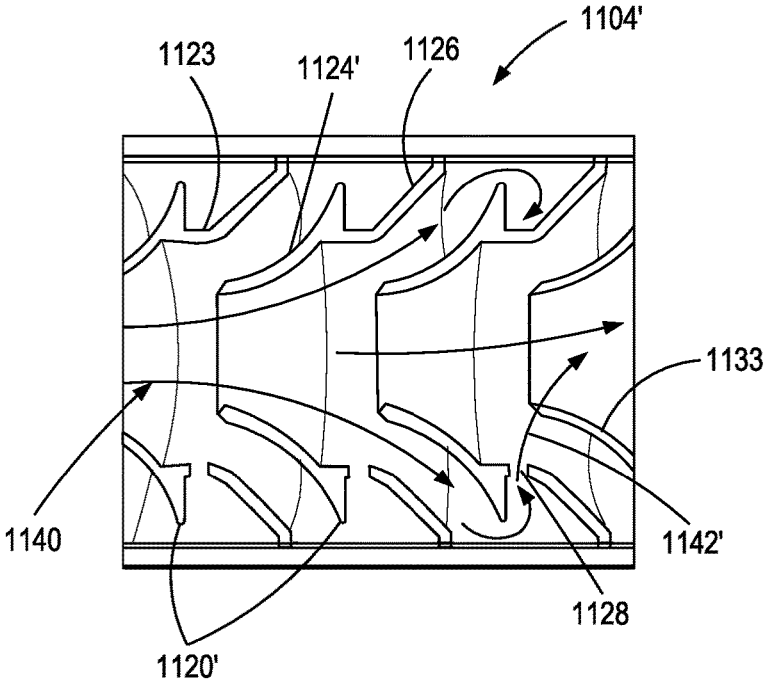
Figure 14A:
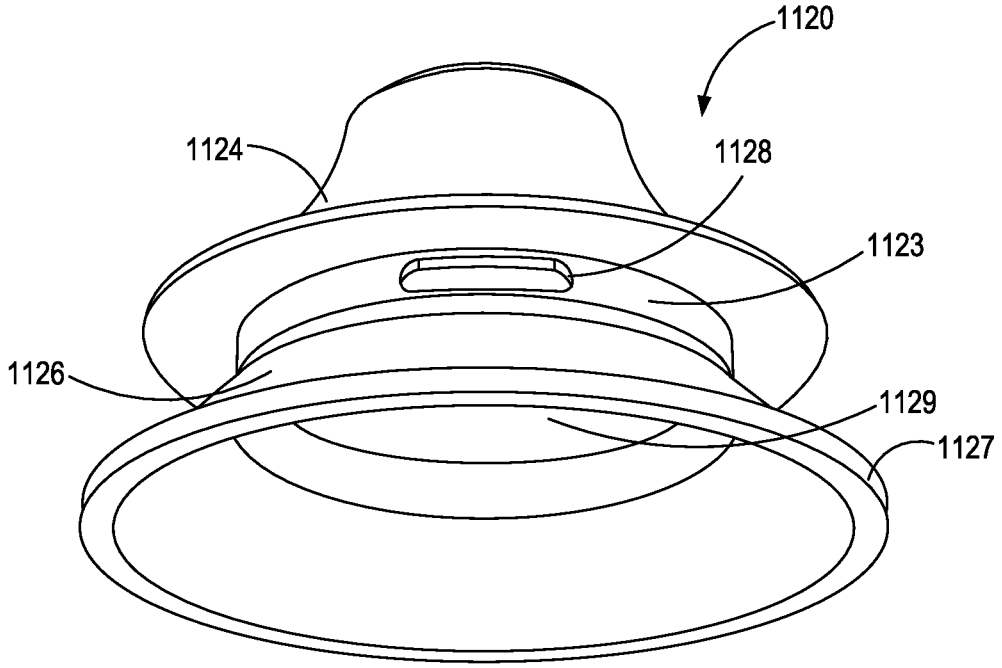
FIG. 14A shows a bottom side perspective view of a second example of a baffle.
Figure 14B:
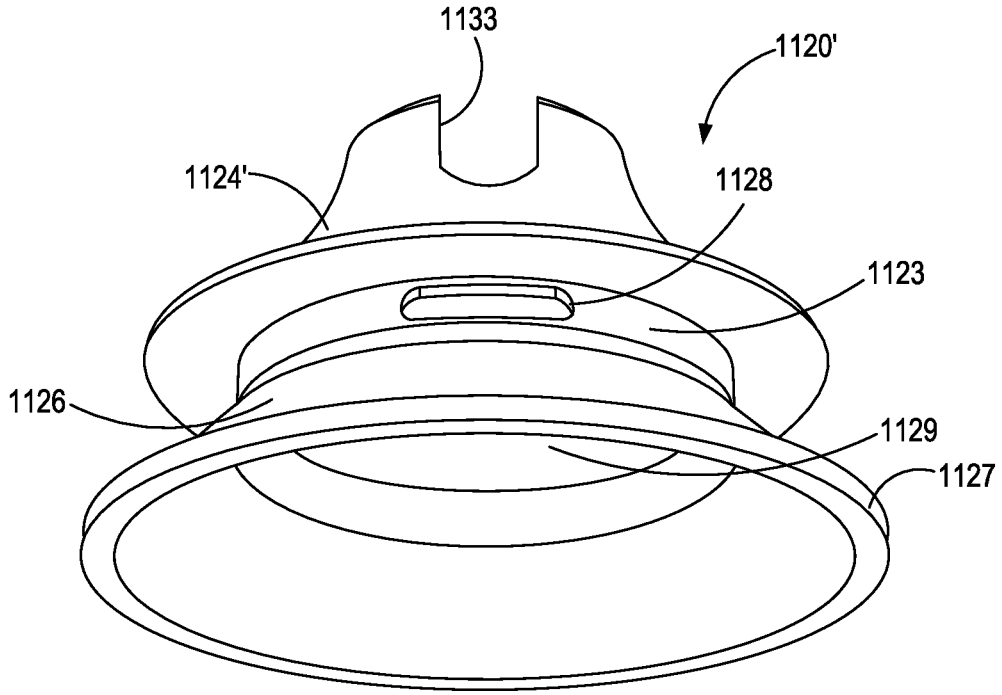
FIG. 14B shows a bottom side perspective view of a third example of a baffle.

FIGS. 13B and 13BB show that the baffles 1120' include a first cone portion 1124' and a second cone portion 1126 that define a passageway 1122 through the baffles 1120 to allow the bullet to escape while providing the advantageous effects upon the escaping gases. The baffles 1120' also include at least one port 1128 that resides in a reduced radius region that connects the cone portion 1124' and cone portion 1126. This reduced radius region is referred to as a reduced radius neck 1123 as shown in FIGS. 13B, 13BB, 14B and others herein. The placement of the port 1128 in the neck 1123 allows the exit of the port to be in closer proximity to the flow of gases through the passageway 1122.

As with the first cone portion 1124 of the second baffle example 1120, it should be noted that the first cone portion 1124' of the third baffle example 1120' also has those multiple differences relative to the first cone portion 124 of the first example discussed above in relation to FIGS. 1-11. This first cone portion 1124' defines the curvature extending from the top of the cone at the smaller radius and diameter to the bottom of the cone at the larger radius and diameter on both the inner and outer surfaces. This first cone portion 1124' is elongated in the axial dimension of the suppressor 1100'. This first cone portion 1124' has a larger outer radius and diameter. The first cone portion 1124' allows a spacing where the small radius and diameter portion of the first cone portion 1124' is present in close proximity to the port 1128 of the adjacent baffle 1120. Again, it will be appreciated that one or all of these differences may be applied to a baffle that otherwise is designed like the first baffle example 120.

In addition to those differences, the first cone portion 1124' of the third baffle example 1120' also has a difference relative to both the second baffle example 1120 and the first baffle example 120. Namely, the first cone portion 1124' of the third baffle example 1120' includes a notch 1133 formed at the top edge 1121' of the first cone portion 1124'. It will be appreciated that the notch 1133 may also be included in the first baffle example 120 in order to adjust the gas flow dynamics as desired. The gas flow dynamics related to the presence of the notch 1133 are discussed with reference to FIGS. 13B and 13BB.

In FIGS. 13B and 13BB it can be seen that the hot gases have a direction of flow 1140 passing into the passageway 1122 of the stack 1130 of baffles that resides within the suppressor body 1108. The hot gas flow 1140 encounters the baffles 1120' and some of the flow through the passageway 1122 is diverted by the first cone portion 1124' of each baffle. As the first cone portion 1124' of this example has a diameter for at least some amount of the cone portion or circumference, or the entire cone portion circumference in some examples, that is smaller than spacers 1132 that are present to separate each of the baffles 1120 at a desired distance, the gases flow beyond the outer edge of the first cone portion 1124 so as to encircle the reduced radius neck 1123 within a region 1125 created by the underside of the first cone portion 1124, the neck 1123, and the top side of the second cone portion 1126.

Additionally, the presence of the notch 133 allows the gas flow to also proceed through the notch 133 in a direction 1142' that is other than axial to the suppressor body 108. The interaction of the port 1128 and notch 1133 are further discussed below.

In this example, the outer diameter of the second cone portion 1126 and flange 1127 is large enough for at least some amount of the cone portion circumference, or the entire cone portion circumference in some examples, to prevent the gas flow from escaping around those outer edges of the second cone portion 1126 so that gas flow is instead directed through the at least one port 1128 in the neck 1123. While not shown for the third baffle example 1120', the underside of the second portion 1126 may include a ridge like the ridge 131 of the first baffle example 120 that also helps to direct the gas flow around the first cone portion 1124' of the next baffle 1120'.

The pressure of the gases within the region 1125 cause the gas flow to travel through the port 1128 in the neck 1123 where the gas flow 1142, 1142' escaping the port 1128 is initially at an angle that is perpendicular to the flow of gas through the passageway 1122 as viewed down the longitudinal axis of the passageway 1122. It will be appreciated that in the view of FIG. 13B, the direction of gas flow 1142 is out of the page, and the arrow of gas flow direction 1142 uses the convention of a circle with a center dot to represent that that arrow of gas flow direction 1142 is pointing out of the page. Because the port 1128 is present in the neck 1123, the exit of the port 1128 is in closer proximity to the gas flow through the passageway 1122, which is believed to further increase the disruption of the gas flow through the passageway 1122. It will also be noted that in this particular example, the portion 1128 is immediate adjacent the top of the next baffle 1120 in the series so that the gas flow 1142 is immediately adjacent the entry to this next baffle 1120 in the series.

The flow of gases out of the port 1128 and across the flow of gases through the passageway 1122 disrupts the flow of gases through the passageway 1122 and further diverts flow around the first cone portion 1124' of the next baffle 1120 in the configuration. This gas flow disruption occurs for each baffle the gas flow encounters when traveling through the suppressor 1104. Furthermore, where the port 1128 of one baffle 1120' is aligned with the notch 1133 of the next baffle in the series, as is shown in FIGS. 13B and 13BB, the gas flow 1142' occurs where the gas flow out of the port 128 proceeds through the notch 1133 of that next baffle 1120' which creates additional flow disruption for gases traveling through the passageway 1122. It is this disruption of the flow of gases through the passageway 1122 by way of the gas flow escaping through the port 1128 and traveling across the passageway 1122 as in flow 1142 and/or through the notch 1133 as in flow 1142' that results in the reduction of sound and/or flash that ultimately exits out the end of the suppressor body 1108. While a single port 1128 of a given shape is shown in the figures, it will be appreciated that additional ports 1128 may also be present and may have a different shape than that shown while still being capable of channeling gas flow across the flow of gas through the passageway 1122 so as to disrupt the gas flow.

The length of the suppressor 1104, the number of baffles to include, and the spacing of the baffles can be chosen to balance interests of cost, weight, and suppression level. However, as shown in FIGS. 13B and 13BB, it is also effective to include the first cone portion 1124' within the interior space defined by the second cone portion 1126 of the preceding baffle 1120' in some examples. The materials chosen for the suppressor body 1108, spacers, and baffles can also vary depending upon cost, durability, and weight. Materials that can be used for these components of the suppressor 1104 include rigid materials such as metals and other rigid materials. Examples of metals include but are not limited to aluminum, stainless steel, titanium alloys, and the like.

It will be appreciated that for this third example, the outer appearance of the stack 1130 of baffles with the spacers 1132 in position looks essentially like that of FIGS. 3A and 3B except for the differences noted in the features of the individual baffles present therein.

Figure 15B:
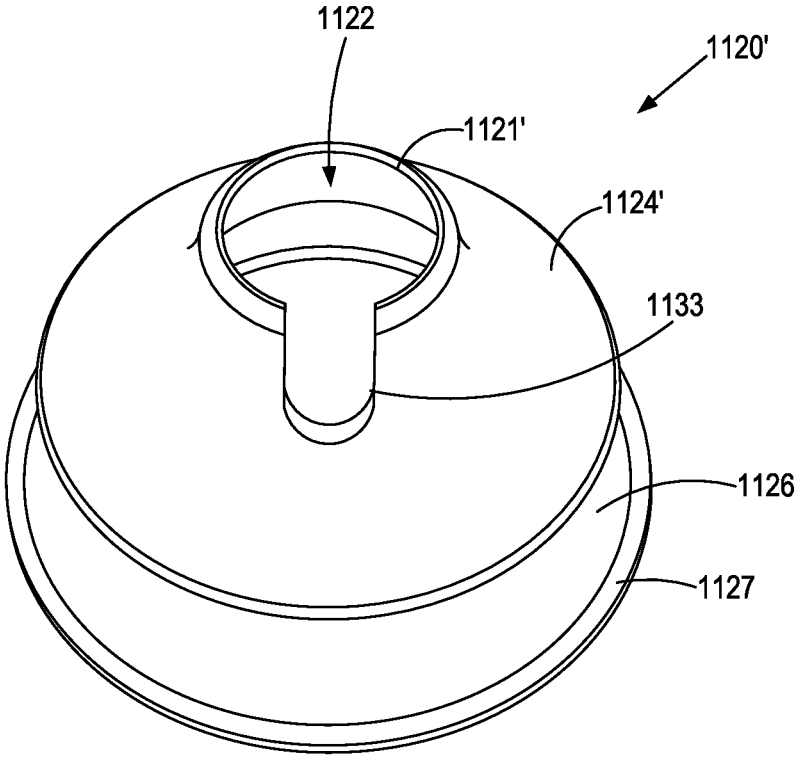
FIG. 15B shows a top side perspective view of the third baffle example.
Figure 16B:
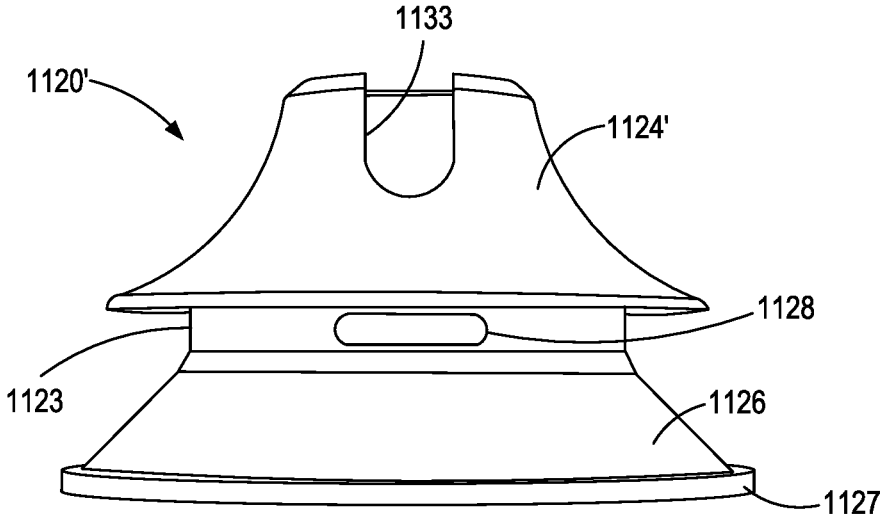
FIG. 16B shows a front view of the third baffle example.
Figure 18B:
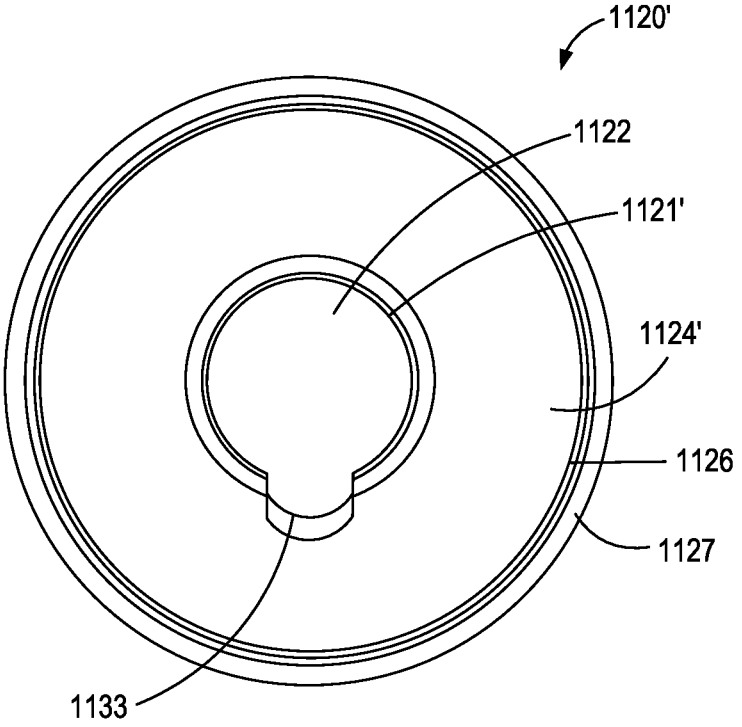
FIG. 18B shows a top view of the third baffle example.

FIGS. 14B, 15B, 16B, 17, 17B, and 18B show various views of an individual baffle 1120'. Within these views, it can be seen that this example includes features such as a flange 1127 around the second cone portion 1126 where the flange 1127 engages that inner surface of the suppressor body 1108 and also engages spacers 1132 on each side of the flange 1127. It can be seen that in this example, the second cone portion 1126 includes a conical inner surface that provides room for the first cone portion 1124' of the next baffle 1120' in the stack 1130. Figures including FIG. 15B and FIG. 18B show that the first cone portion 1124' includes a defined hole 1121 that creates the passageway 1122 for the bullet while also defining the notch 1133. FIGS. 16B and 17 illustrate the port 1128 and its presence in the neck 1123 having the reduced radius relative to the outer radius of the first cone portion 1124'.

Figure 19B:
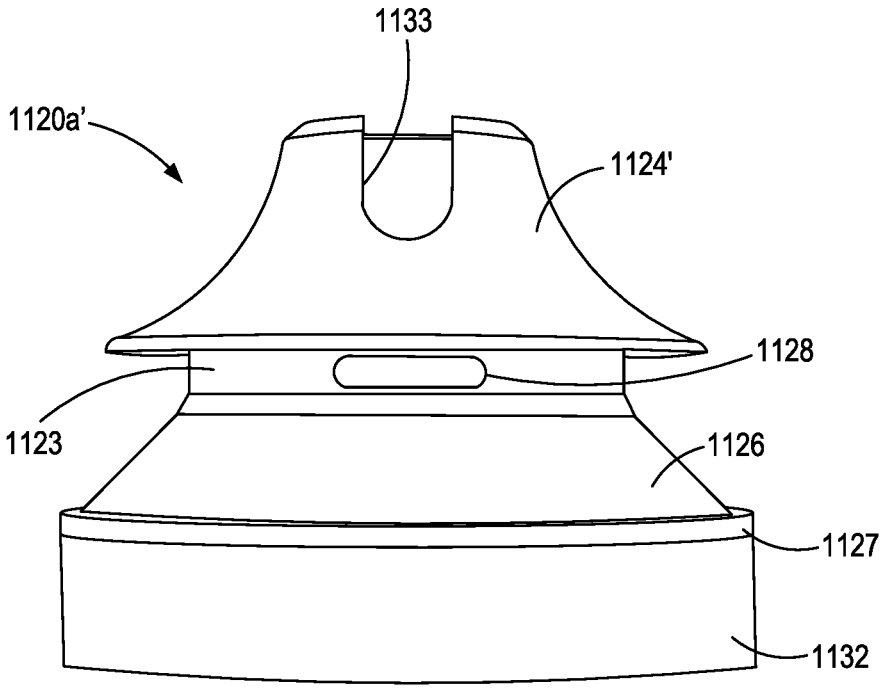
FIG. 19B shows a front view of the third baffle example that includes a spacer.

FIG. 19B shows an individual baffle 1120*a*' that is the same as the baffle 1120' above but also includes the spacer 1132. The spacer 1132 may be an integral component of the baffle 1120*a*' that is either machined from the same block of material, additively manufactured as one piece of material, or created from two separate components that are joined together by a weld or other manner. Alternatively, the spacer 1132 may exist as a separate component where the flange 1127 merely sits upon the edge of the spacer 1132. At least one port 1128 is present in baffle 1120*a*' such that the gas flow is directed the same for this example regardless of whether the spacer 1132 is integral to the baffle 1120*a*' or a separate component. The size of the spacer 1132 can vary, and the size dictates the proximity of the baffles 1120' to each other and also dictates the number of baffles that can fit within a given suppressor body 1108. Thus, the spacer 1132 can be sized so that a given suppressor body 1108 can accommodate the desired number of baffles 1120' and/or the desired spacing of the baffles 1120'.

Thus, it can be seen and understood from the discussion above in relation to FIGS. 1-19B that the baffle designs disclosed herein and the multi-baffle configurations also disclosed herein are advantageous by altering the flow of gases through the firearm suppressor to reduce the amount of sound and flash escaping from the firearm suppressor.

While embodiments have been particularly shown and described, it will be understood by those skilled in the art that various other changes in the form and details may be made therein without departing from the spirit and scope of the invention.

What is claimed is:

1. A suppressor for a firearm, comprising:

a suppressor body; and at least one baffle having a fixed position within the suppressor, the at least one baffle comprising:

a first cone portion having an outer radius, the first cone portion defining a passageway that passes through the first cone portion, an open space being present between an entire circumference of the outer radius of the first cone portion and the suppressor body;

a second cone portion having an outer diameter, the second cone portion further defining the passageway that passes through the second cone portion, the second cone portion adjoining the suppressor body at the outer diameter of the second cone portion; and a neck connecting the first cone portion to the second cone portion, the neck having a reduced radius relative to the outer radius of the first cone portion, the neck comprising a port that passes through the neck to provide an exit into the passageway.

2. The suppressor of claim 1, wherein the at least one baffle comprises a plurality of baffles.

3. The suppressor of claim 2, wherein the ports of the baffles of the plurality of baffles are aligned.

4. The suppressor of claim 1, wherein the second cone portion comprises a flange providing the outer diameter.

5. The suppressor of claim 1, wherein the second cone portion comprises a ridge on a side of the second cone portion opposite from the neck.

6. The suppressor of claim 1, wherein a spacer extends from the second cone portion.

7. The suppressor of claim 1, wherein the first cone portion comprises a notch formed in a top edge.

8. The suppressor of claim 7, wherein the port and the notch of the at least one baffle are aligned.

9. The suppressor of claim 8, wherein the at least one baffle comprises a plurality of baffles with each baffle having the port and the notch that are aligned and wherein the port and notch of each baffle is aligned with the port and notch of the other baffles of the plurality.

10. The suppressor of claim 1, wherein the first cone portion defines a curvature on the outer surface extending from a top of the first cone portion at a smallest radius of the first cone portion and to the bottom of the first cone portion at a largest radius of the first cone portion.

11. A baffle for a suppressor of a firearm, comprising:

a first cone portion having an outer radius and, the first cone portion defining a passageway that passes through the first cone portion;

a second cone portion further defining the passageway that passes through the second cone portion, the second cone portion having a height measured from a largest diameter of the second cone portion to a smallest diameter of the second cone portion; and a neck connecting the first cone portion to the second cone portion, the neck having a reduced radius relative to the outer radius of the first cone portion, the neck comprising a port that passes through the neck to provide an exit into the passageway, the neck having a height measured from the smallest diameter of the second cone portion to a largest diameter of the first cone portion, the height of the second cone portion being greater than the height of the neck.

12. The baffle of claim 11, wherein the second cone portion comprises a flange providing the outer diameter.

13. The baffle of claim 11, wherein the second cone portion comprises a ridge on a side of the second cone portion opposite from the neck.

14. The baffle of claim 11, wherein a spacer extends from the second cone portion.

15. The baffle of claim 11, wherein the first cone portion comprises a notch formed in a top edge.

16. The baffle of claim 15, wherein the port and the notch are aligned.

17. The baffle of claim 11, wherein the first cone portion defines a curvature on the outer surface extending from a top of the first cone portion at a smallest radius of the first cone portion and to the bottom of the first cone portion at a largest radius of the first cone portion.

18. A firearm, comprising:

a barrel; and a suppressor mounted on an end of the barrel, the suppressor comprising:

a suppressor body; and at least one baffle having a fixed position within the suppressor, the at least one baffle comprising:

a first cone portion having an outer radius, the first cone portion defining a passageway that passes through the first cone portion, an open space being present between an entire circumference of the outer radius of the first cone portion and the suppressor body;

a second cone portion having an outer diameter, the second cone portion further defining the passageway that passes through the second cone portion, the second cone portion adjoining the suppressor body at the outer diameter of the second cone portion; and a neck connecting the first cone portion to the second cone portion, the neck having a reduced radius relative to the outer radius of the first cone portion, the neck comprising a port that passes through the neck to provide an exit into the passageway.

19. The firearm of claim 18, wherein the first cone portion comprises a notch formed in a top edge, wherein the port and the notch of the at least one baffle are aligned, and wherein the at least one baffle comprises a plurality of baffles with each baffle having the port and the notch that are aligned and wherein the port and notch of each baffle is aligned with the port and notch of the other baffles of the plurality.

20. The firearm of claim 18, wherein the first cone portion defines a curvature on the outer surface extending from a top of the first cone portion at a smallest radius of the first cone portion and to the bottom of the first cone portion at a largest radius of the first cone portion.

* * * * *